United States Patent [19]

van der Veer

[11] 4,081,235

[45] Mar. 28, 1978

[54] VALVE INTERLOCK

[75] Inventor: Rutgerus Antonius van der Veer, Tujunga, Calif.

[73] Assignee: International Telephone and Telegraph Corporation, New York, N.Y.

[21] Appl. No.: 698,864

[22] Filed: Jun. 23, 1976

[51] Int. Cl.² ..... F23N 5/10; F16K 35/14

[52] U.S. Cl. ..... 431/54; 137/66; 137/637.1

[58] Field of Search ..... 137/66, 637.1; 431/52, 431/53, 54; 251/103

[56] References Cited

U.S. PATENT DOCUMENTS

| | | | |
|---|---|---|---|
| 3,303,866 | 2/1967 | Ray | 431/54 |
| 3,446,227 | 5/1969 | Grayson | 137/269 X |
| 3,476,130 | 11/1969 | Kingma | 251/287 X |
| 3,682,188 | 8/1972 | Randolph et al. | 431/54 X |

*Primary Examiner*—Martin P. Schwadron
*Assistant Examiner*—Richard Gerard
*Attorney, Agent, or Firm*—A. Donald Stolzy

[57] ABSTRACT

It is conventional to supply current to an electromagnet from thermally responsive means including a thermocouple near a standing pilot to hold a safety valve open. Failure of the pilot then causes the safety valve to close, shutting off all combustible gas to the system. Unfortunately, many manual valves may be shut off and turned on a short time thereafter. This permits the pilot to go out and a dangerously large amount of unburned but combustible gas to collect within the combustion chamber. This disclosure includes an interlock located between the safety and manual valves. The interlock does not permit the manual valve to be opened immediately after closure thereof. Reopening of the manual valve is permitted preferably only at or after the closure of the safety valve. Combustible gas thus cannot collect in the vicinity of the main burner if an attempt is made to close and then immediately thereafter to reopen the manual valve. This is true because the interlock prevents the manual valve from reopening after it has been closed.

4 Claims, 25 Drawing Figures

FIG. 8
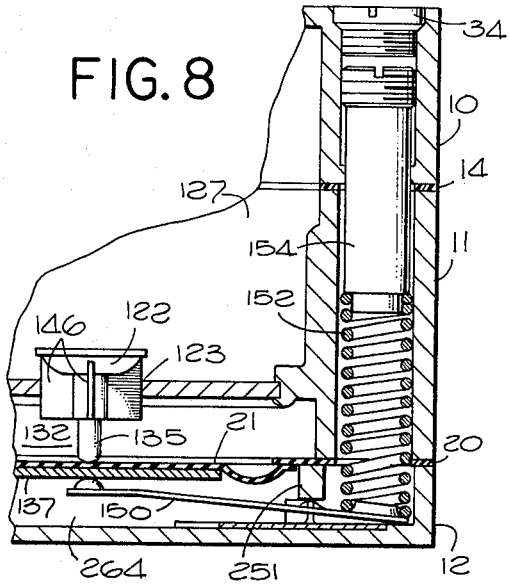
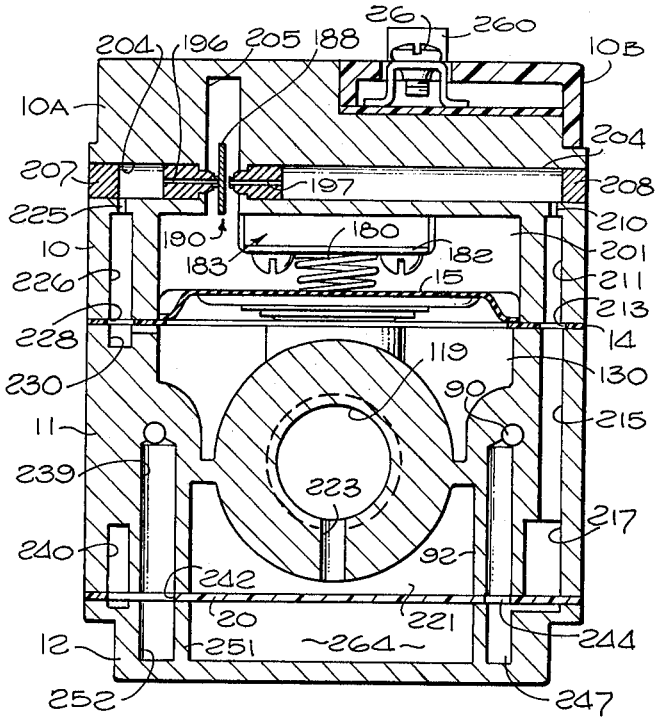
FIG. 9
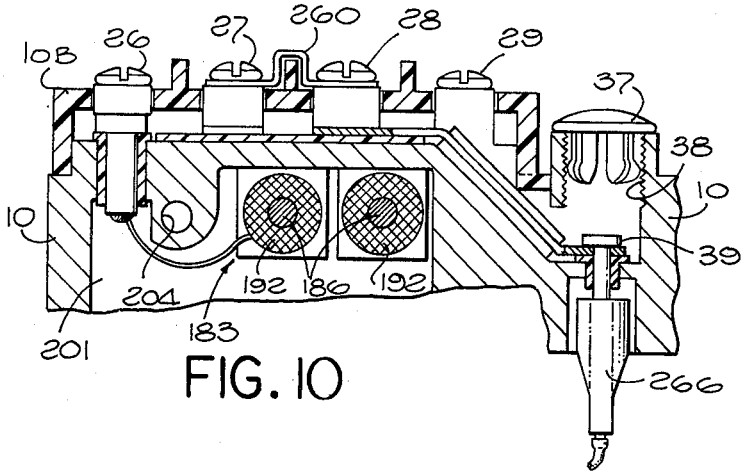
FIG. 10
FIG. 11
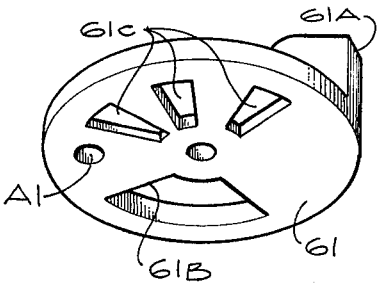
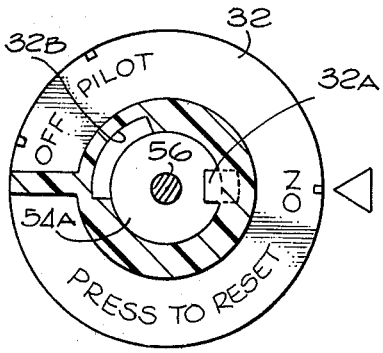
FIG. 12
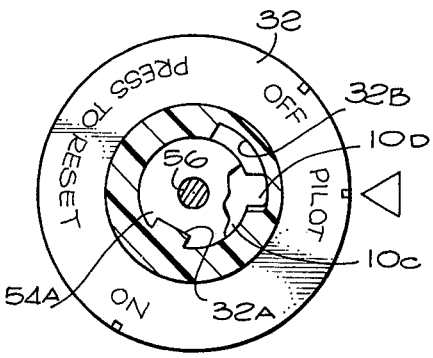
FIG. 13
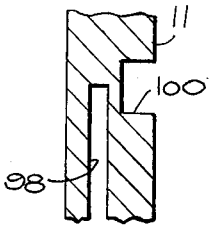
FIG. 20

VALVE INTERLOCK

BACKGROUND OF THE INVENTION

It is conventional to supply current to an electromagnet from thermally responsive means including a thermocouple near a standing pilot to hold a safety valve open. For example, such as arrangement is disclosed in U.S. Pat. No. 3,303,866. Failure of the pilot then causes the safety valve to close, shutting off all combustible gas to the system. Unfortunately, many manual valves may be shut off manually and turned on manually a short time thereafter. This permits the pilot to go out and a dangerously large amount of unburned but combustible gas to collect within the combustion chamber.

One solution to this problem is disclosed in the above-mentioned patent.

SUMMARY OF THE INVENTION

Another improved solution is achieved in accordance with the present invention by providing a system including an interlock located between the safety an manual valves. The interlock does not permit the manual valve to be opened immediately after closure thereof. Reopening of the manual valve is permitted preferably only at or after the closure of the safety valve. Combustible gas thus cannot collect in the vicinity of the manual burner if an attempt is made to close and then immediately thereafter to reopen the manual valve. This is true because the interlock prevents the manual valve from reopening after it has been closed.

The above-described and other advantages of the present invention will be better understood from the following detailed description when considered in connection with the accompanying drawings.

BRIEF DESCRIPTION OF THE DRAWINGS

In the drawings which are to be regarded as merely illustrative:

FIG. 8 is a broken away sectional view taken generally on the line 8—8 shown in FIG. 7;

FIG. 9 is a transverse sectional view taken on the line 9—9 shown in FIG. 4;

FIG. 10 is a broken away longitudinal sectional view taken on the line 10—10 shown in FIG. 1;

FIG. 11 is a perspective view of a valve rotor;

FIGS. 12 and 13 are top plan views of a control knob in different respective positions;

FIG. 20 is a sectional view of a construction of an optional pilot burner connection;

DESCRIPTION OF THE PREFERRED EMBODIMENTS

Figure 1:
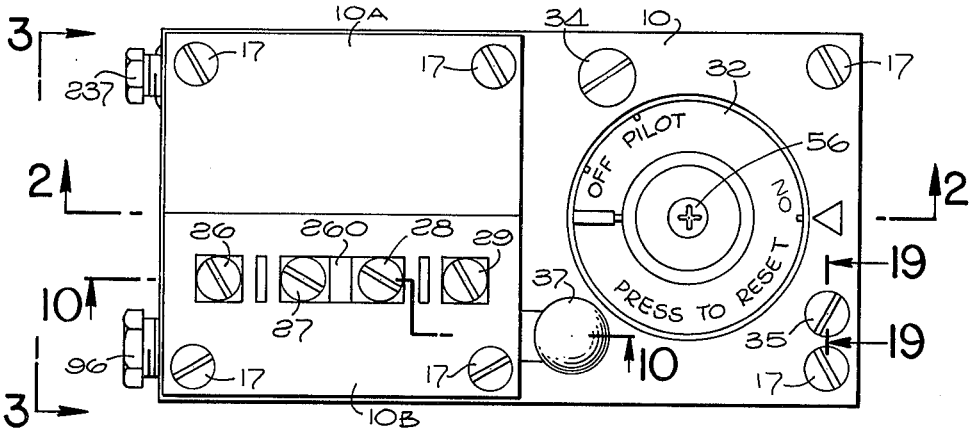
FIG. 1 is a top plan view of one of many combination valves in which the present invention is incorporated.
Figure 2:
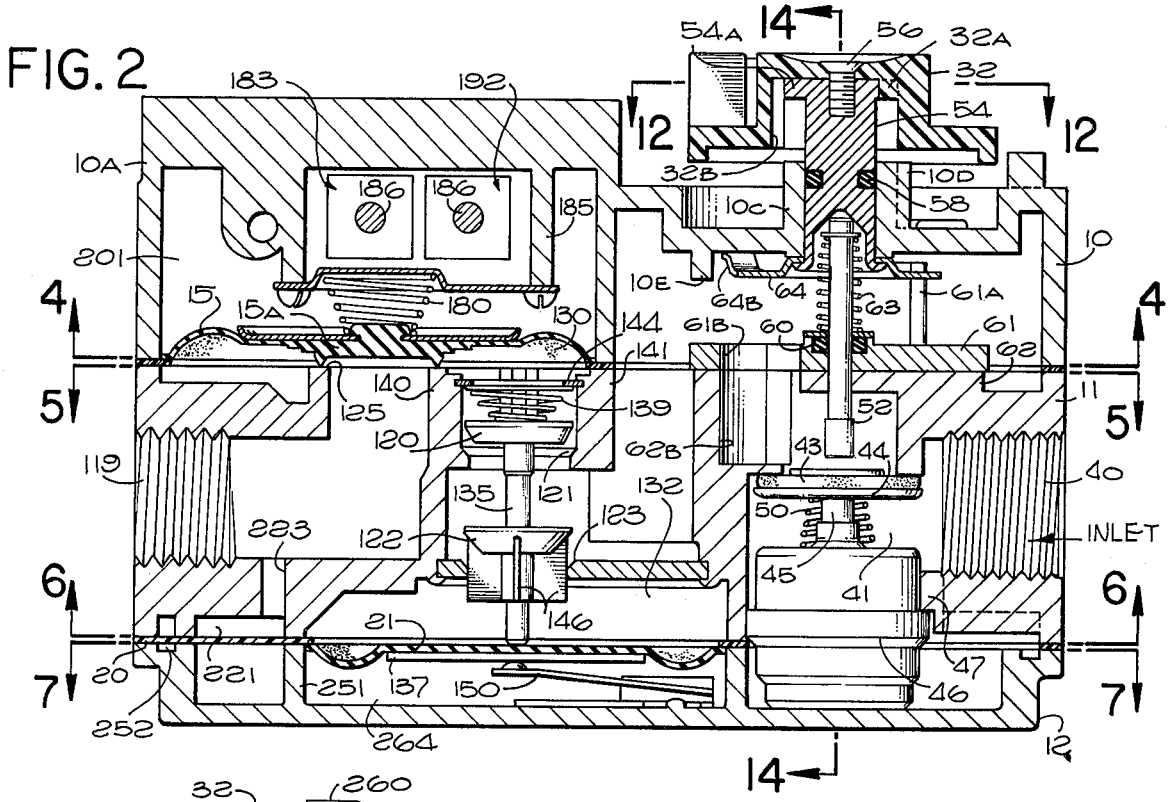
FIG. 2 is a vertical longitudinal sectional view taken on the line 2—2 shown in FIG. 1.

The control of the present invention incorporates some die cast elements, three of which are a top cover member 10 (FIG. 1), a center generally rectangular body member 11 (FIG. 2) and a bottom cover member 12 (FIG. 2). A special flat gasket member 14 having an integrally formed diaphragm 15 is maintained sandwiched between adjacent ground or lapped surfaces of the members 10 and 11 by six bolts 17 (FIG. 1) that releasably secure the top member 10 to the body member 11. A special flat gasket member 20 having an integrally formed diaphragm 21 is maintained sandwiched between adjacent ground or lapped surfaces of the members 11 and 12 by four bolts 22.

The body member 11 and bottom cover member 12 are each generally rectangular as is also the top cover member 10 which, however, is formed with an upper rectangular housing portion 10A (FIG. 2) at one corner thereof adjacent which a rectangular block of insulating material 10B (FIG. 1) is mounted to carry four screw type electrical binding posts 26, 27, 28 and 29.

The upper surface of the top cover member 10 includes not only the four binding posts 26, 27, 28 and 29, but also a manual control knob 32, a plug screw 34 (FIG. 1) which, removed, allows access to a gas regulator adjustment (described later), a plug screw 35 which, when removed, allows access to a pilot gas flow adjustment (described later), and a sprng fingered closure member 37 which, when removed, allows access to an optional coaxial electrical connector 38, 39 (FIG. 10).

The center body member 11 is provided with a threaded inlet opening 40 (FIG. 2) through which all combustible gas flows to a gas inlet chamber 41, the gas being prevented from flowing further in the "OFF" position of the control by a safety valve having an annular stationary valve seat 43 and a rubber movable closure disc 44. This valve disc 44 is mounted on one end of an armature rod 45 which is slidably mounted in a conventional cylindrical metal casing 46 within a region defined by three shouldered, equally spaced circumferential ribs 47, 48 and 49 (FIG. 6) of the die cast housing member 11, these ribs 47, 48 and 49 being shouldered as shown with respect to the rib 47 in FIG. 2 with such shoulders serving to locate the casing 46 during the press-fitting operation. An interference fit is provided between casing 46 and ribs 47, 48 and 49.

Figure 14:
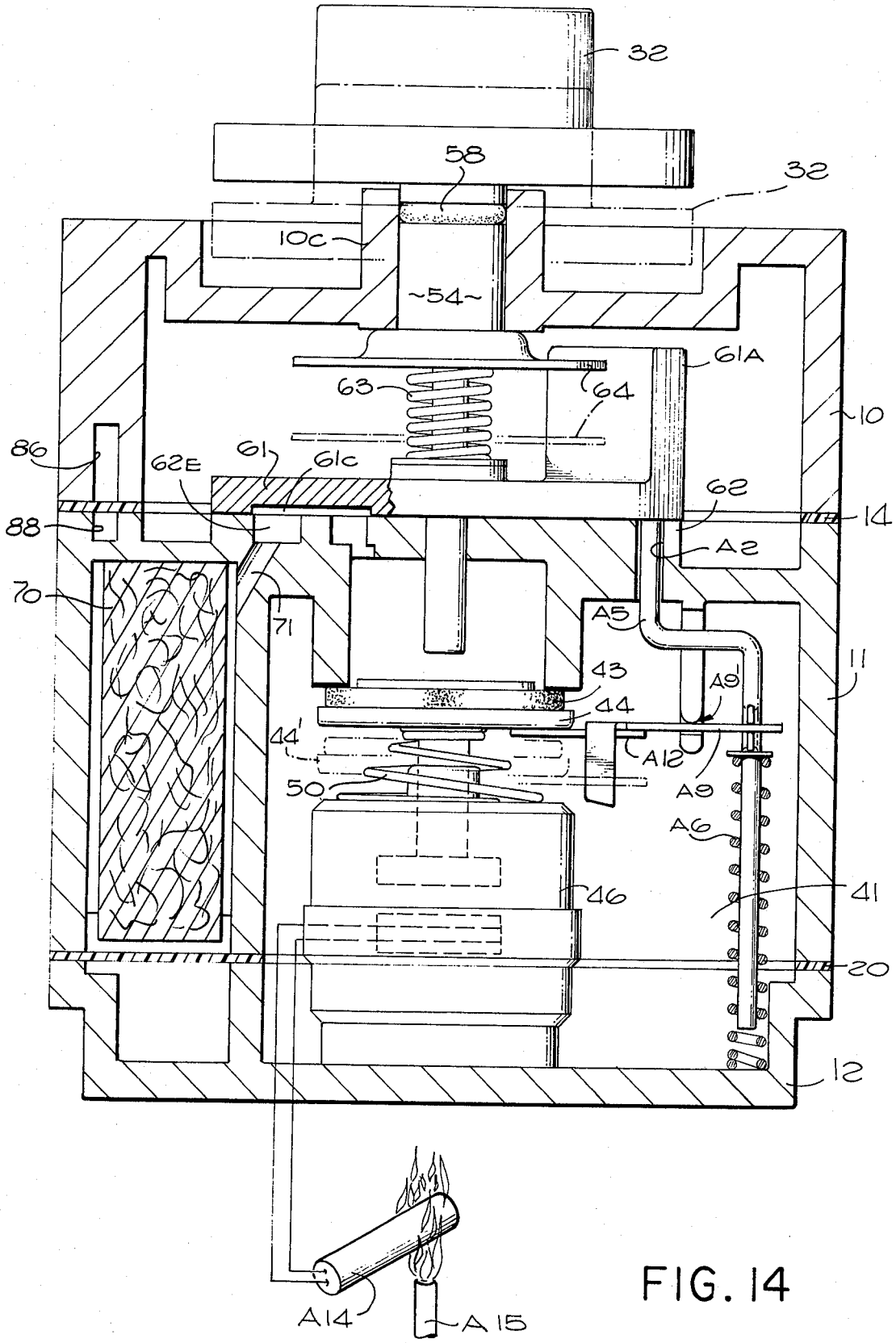
FIG. 14 is a transverse sectional view taken on the line 14—14 shown in FIG. 2.

A coiled compression spring 50 acting between the casing 46 and the valve disc 44 urges the latter against seat 43 normally to close the valve 43, 44 as shown in FIG. 2. The casing 46 contains a conventional electromagnet (not shown) which, when energized, produces insufficient magnetic force to attract and move its associated armature but does develop sufficient magnetic force when energized to maintain such armature in its retracted position once the armature is manually moved there. In other words, the electromagnetically operated valve 43, 44 functions in conventional manner and is energized by current from a thermoelectric generator or thermocouple A14 shown in FIG. 14. The current is supplied in response to heating of thermoelectric generator A14 by a flame at a pilot burner A15 (FIG. 14). In the absence of a suitable pilot flame, the spring 50 causes the valve 43, 44 to return to its closed position. Initially the valve 43, 44 is opened manually by force applied to an operating stem 52 in the manner described later involving an operating mechanism which includes the knob 32 for that purpose.

The rotatable knob 32 as seen in FIG. 1 has three positions designated by three symbols. These symbols may be the same as or different from "OFF", "PILOT" and "ON". Knob 32 may be pressed downwardly to open valve 43, 44 only when the knob is rotated to be in a position between the "OFF" and "PILOT" positions. For these purposes the knob 32 is retained in indexed relationship with a slidable and rotatable shaft 54 by a screw 56 with an internal lug 32A of the knob 32 fitted into a notched portion in the flanged portion 54A of shaft 54. It will be seen that this shaft 54 is slidably mounted in a raised boss portion 10C of cover member 10 with a sealing O-ring recessed in the shaft 54. Boss 10C has an integrally formed lug 10D extending radially outwardly therefrom which does not allow the knob 32 to be pressed inwardly in the "ON" position of the knob 32 shown in FIGS. 1 and 2. When, however, the knob 32 is rotated to a position between the "ON" and "PILOT" positions, an inner notched portion 32B of the knob is then adjacent the boss lug 10D allowing the knob 32 then to be pressed inwardly for purposes of opening valve 43, 44 and moving the armature (not shown) attached to shaft 45 into magnetic cooperation with the electromagnet (not shown) in casing 46, the force for opening of the valve being transmitted through shaft 54 and stem 52 which has an enlarged head portion engaging a recessed portion of stem 54. Stem 52 passes in turn through aligned apertured portions in an O-ring seal 60 recessed within a die cast rotor valve element 61, an apertured portion in rotor 61, and an apertured portion in the cooperating stator portion 62. A coil compression spring 63 around pin 52 has one of its ends bearing against an enlarged head portion of stem 52 and the other one of its ends bearing on the rotor valve element 61 to urge the shaft 54 and knob 32 attached thereto upwardly and outwardly. For convenience in assembly, one end of stem 52 is bifurcated at 52A to provide spring retaining fingers that are sufficiently resilient to allow the pin to be pressed through the above-mentioned aligned apertured portions.

The valve rotor 61 is coupled to the shaft 54 using the following construction. A sheet metal dics 64 is secured, as, for example, by staking or riveting to one end of shaft 54 and has a notched portion 64A (FIG. 4) engageable with an integrally formed raised lug 61A on rotor 61, the lug 61A being raised sufficiently to maintain continuous engagement with such notched portion 64A in all positions of the knob 32.

To limit rotational movement of the knob 32 only between that region between the "OFF" and "ON" positions which includes the "PILOT" position, there is provided a raised arcuate head portion 10E (FIGS. 2 and 4) on casing member 10, the opposite ends of which engage and act as a stop member for the rotor lug 61A in the "ON" and "OFF" positions.

It is desirable for an operator in operation of the heating equipment to change the setting of the control from an "ON" condition to a "PILOT" condition as, for example, when he services the equipment and this is done by rotating the knob from the "ON" position to the "PILOT" position and, in such manipulation, means are provided to prevent inadvertent travel of the knob past the "PILOT" position to the "OFF" position. Such means involves a pair of raised abutments 10F, 10G (FIG. 4) located 180 degrees apart on the underside of housing member 10 which engage and serve as stop members for the pair of ears 64B, 64C on the sheet metal disc 64. In order to move these ears past these abutments, some downward or inward pressure must be applied to the knob to overcome the force of spring 63 at which time the knob 32 may be rotated from the "PILOT" position towards the "OFF" position, if so desired when complete shutdown of the system is desired.

In the "PILOT" position, gas may flow only to a pilot burner and in the "OFF" position, gas is prevented from flowing to the pilot burner in which case there is no pilot flame. The associated thermoelectric generator or thermocouple 14 is then no longer heated and the electromagnetically maintained valve 43, 44 is allowed to close under the influence of spring 50 and inlet gas. Gas is then shut off to the system. Thus, by providing such stop members 10F, 10G (FIG. 4), there is no inadvertent shutting down of the complete system.

Figure 5:
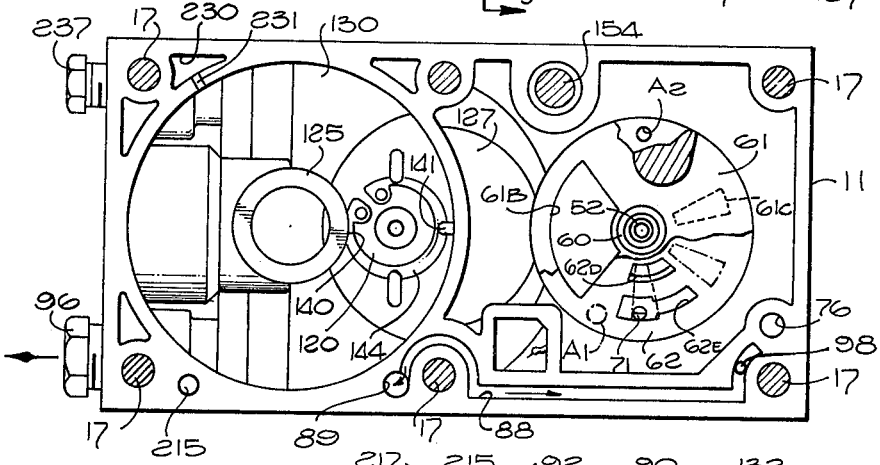
Figure 15:
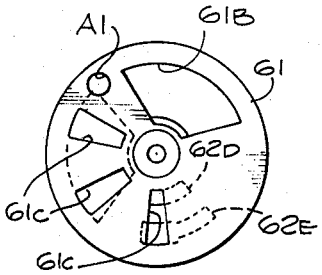
FIGS. 15 and 16 are different respective bottom plan views of the said rotor.
Figure 16:
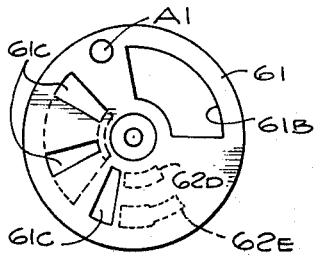

It will be seen that the rotor 61 has a segmental opening 61B (FIG. 11) extending completely therethrough. Opening 61B can lie in registry with a like opening 62B (FIG. 2) in stator portion 62 in the "ON" position of knob 32. Rotor 61 has a series of three spaced shallow grooved portions 61C also segment shaped, serving in succession, during rotation of rotor 61 to place pilot gas opening 62D (FIG. 5) in stator 62 in communication with a grooved portion 62E in such stator 62, such grooved portion being in communication with a pilot gas filter housing 70 (FIG. 14) via a drilled hole 71 (FIG. 5) forming the inlet to the filter housing 70. Rotor 61 has a recess A1 therein to receive pin A5 (FIG. 14). Stator portion 62 has a hole A2 therethrough. Pilot gas may thus flow to the filter housing 70 and to the pilot burner 15 in all positions of knob 32 except in its "OFF" position as indicated in FIGS. 15 and 16. The reason for providing three separate small pilot gas grooves 61C in the rotor 61 instead of one large groove is based on the consideration that the pressure of the gas acts to tend to lift the rotor 61 from its mating stator 62 and the total force tending to produce such lift is reduced by reducing the area on which the gas pressure operates. Thus, at any one time (between "PILOT" and "ON" positions), the surface provided by not more than two small grooves 61C defines the effective area instead of one large groove that would otherwise have to encompass all three grooves 61C. The force tending to unseat the rotor is thereby minimized and the lighter spring 63 may be provided, in turn, to reduce wear on the mating rotor and stator surfaces.

Figure 6:
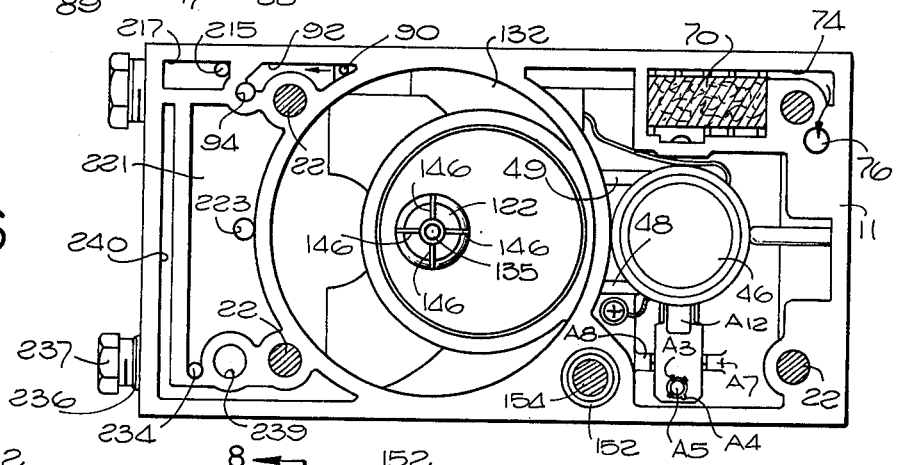
Figure 22:
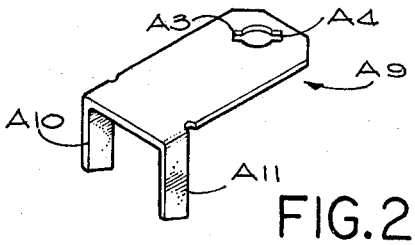
FIG. 22 is a perspective view of a component part shown in FIG. 14.
Figure 21:
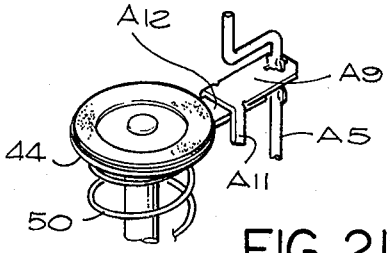
FIG. 21 is a broken away perspective view of a subassembly shown in FIG. 14.
Figure 23:
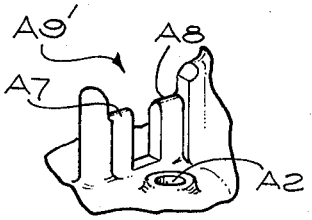
FIG. 23 is a perspective view of a portion of the casting of FIG. 6.

In FIG. 6 a tab A12 is fixed relative to the valve retainer disc 44 and lifts a lever A9 pivoted between legs A7 and A8 of a fulcrum A9' (FIG. 23). Lever A9 has legs A10 and A11 which straddle tab A12 (FIGS. 21 and 22).

The flow of pilot gas from the outlet of filter housing 70 is now described under the assumed condition that the knob 32 is in its "PILOT" position and valve 43, 44 has been reset such that valve 43, 44 is now maintained in its open position by thermocouple current developed by burning pilot gas.

Gas from the outlet of filter housing 70 flows through a shallow grooved portion 74 in casing member 11 (FIG. 6), such grooved portion 74 being partially covered by gasket member 20 (FIG. 18) which has a slotted portion 75 therethrough serving to intercommunicate the grooved portion 74 with a bore hole 76 in casing member 11. Hole 76 extends through the center casing member 11 and communicates via the apertured portion 78 in upper gasket 14 with one end of a bore 80 in top cover member 10, the other end of bore 80 being closed by a pilot gas metering valve element 82 which adjustably controls the flow of pilot gas to a branch bore hole 84 that communicates with one end of the slotted portion or maniold 86 in casing member 10, this slotted portion 86 being in communication via an apertured portion 87 in gasket 14 with a slotted portion 88 in center casing member 11, this slotted portion 88 being in communication with a vertical bore hole 89 (FIG. 5) which is intersected by an angled bore hole 90 (FIG. 6). This angled hole or passageway 90 thus introduces pilot gas to a grooved portion 92 from where it flows via vertical bore hole 94 to a threaded pilot burner connector 96. In those instances where it is desirable to have the pilot burner connected on the right hand end of the unit (FIG. 1) adjacent the gas inlet opening instead of adjacent the main gas outlet as described above, such right hand end may optionally be provided with a tapped hole (not shown) for a pilot burner connection with such tapped hole being in communication with the auxiliary vertical bore 98 which is in communication with the slotted portion 88 where filtered and metered pilot gas is present. Provisions for this optional pilot burner connection may be made in die casting the casting 11, as shown in FIG. 20, wherein for achieving this purpose of blind hole 100 is extended so that it then communicates with bore hole 98 with such hole 100 then being tapped to receive a fitting. Also this may be done in which case the tapped hole may then be fitted with a plug when, as described above, the pilot gas outlet is adjacent, i.e. on the same side as the main gas outlet.

For the main gas flow from the inlet opening 40 to the outlet opening 119 it is necessary that three valves be open. These valves are, in the order of gas flow: the electromagnetically maintained safety valve 43, 44; the manual valve 61, 62 open in the "ON" position of knob 32; a semibalanced gas pressure regulator valve comprising the jointly movable valve elements 120, 122 cooperating respectively with seats 121, 123 (such regulator valve always being open in different amounts); and a pilot operated diaphragm valve comprising diaphragm 15 and its cooperating valve seat 125. More specifically the gas in inlet chamber 41, under the above conditions, flows through the valve 43, 44 and through the then aligned stator openings 62B and rotor opening 61B into the chamber 127. From chamber 127 the main gas flow takes two parallel paths, one of which extends through the regulator valve section 120, 121 to a chamber 130 and the other one of which extends through the other regulator valve section 122, 123 to the chamber 132 being in free communication with chamber 130 so that these two parallel paths merge into the same chamber 130. It is noted that chamber 130 is defined essentially by that annular portion of diaphragm 15 which is between its clamped peripherical portion and its annular raised portion 15A which engages the seat 125 in the closed position of valve 15, 125. When this valve 15, 125 is open, as assumed, the gas flow is from chamber 130 via valve 15, 125 to the outlet opening 119.

The gas pressure regulator valve comprising the two sections 120, 121 and 122, 123 is on the downstream side of the manually operated disc valve 61, 62 and on the upstream side of pilot operated valve 15, 125, and its function is to automatically regulate the gas pressure to a substantially constant gas pressure at the oulet opening 119 when the pilot operated valve 15, 125 is open.

For this purpose, a pair of tapered valve discs 120, 122 are joined by a shaft 135 which is extended to engage the central portion of diaphragm 21 backed by a steel disc 137. A coil compression spring 139 has one of its ends seated on valve disc 120 and the other one of its ends retained by shouldered portions of ribs 140, 141 with such other end of the spring 139 engaging such shouldered portions directly or as shown with an intermediate washer 144 engaging such shouldered portions so that the two valve discs 120, 122 are urged constantly towards their corresponding seats 121, 123 by spring 139. For guiding the movement of these valve discs, there are provided four fin portions 146 in the form of plates on the downsteam side of valve disc 122 with the ends of four fin portions 146 cooperating with the annular opening defining the seat 123. It will be seen that the valve discs 120, 122 are moved in accordance with gas pressure acting on the top side of diaphragm 21 (FIG. 2). When valves 120, 121 and 122, 123 are moved closer to valve closing position, the pressure in chamber 132 or chamber 130 increases whereby such valves 120, 121 and 122, 123 produce a throttling action to maintain automatically a substantially constant outlet pressure when valve 15, 125 is open.

That pressure maintained substantially constant may be adjusted manually using the following structure. A lever 150 (FIGS. 2 and 8), pivoted at a point intermediate its ends, has one of its ends bearing against a central portion of steel backing disc 137 and the other one of its ends formed as a seat for one end of coil compression spring 152 which has its other end bearing against an adjustable screw threaded plug 154, such plug being accessible for adjustment upon removal of the screw theaded plug 34. The spring 152 is heavier than spring 139, the spring 139 being light spring which assures contact of the end of shaft 135 with the diaphragm 21 and the adjusted force establishing the value of regulated pressure since the deflection of diaphragm 21 and the setting of valves 120, 121 and 122, 123 is established essentially by gas pressure and spring 152.

The pilot operated diaphragm valve 15, 125 is a normally closed valve and requires an input signal to effect its opening. Briefly, the valve 15, 125 is maintained closed by both sides of its diaphragm 15 being subjected to the same gas inlet pressure and when it is desired to open the valve, one side only is subjected to inlet gas pressure so that such inlet pressure effects an opening of the valve 15, 125, the other side of the diaphragm for this latter purpose being suitably vented to achieve a differential pressure for producing movement of the diaphragm to its valve opening position.

The diaphragm 15 is urged toward its seat 125 by a light spring 180 acting together with the inherent resiliency of the diaphragm 15. The spring 180 has one of its ends bearing on the diaphragm 15 with a protuberance of the diaphragm extending upwardly into the spring 180 to retain such spring, the other end of the spring 180 bearing against a recessed portion of a plate 182 which forms a housing for an electromagnet 183, such plate 182 having extended portions which are secured by screws to rib members 184, 185 of cover member 10.

Figure 4:
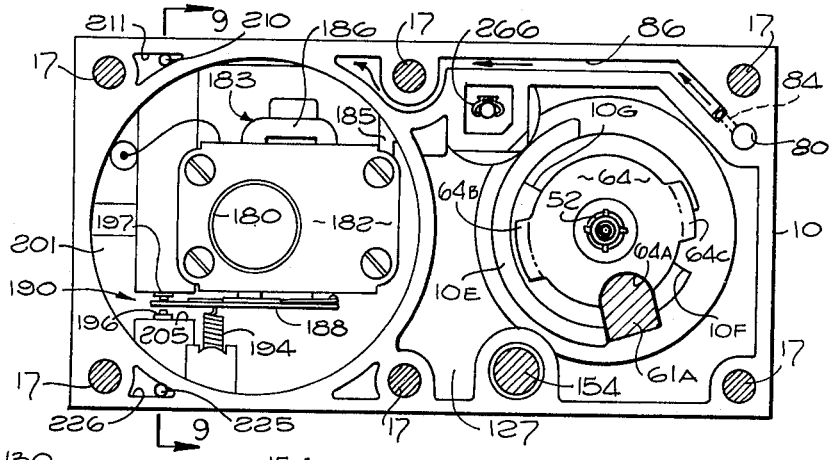
FIGS. 4, 5, 6 and 7 are views taken generally in the directions indicated by corresponding lines 4—4, 5—5, 6—6 and 7—7 shown in FIG. 2.

The electromagnet 183 is considered of conventional construction and involves a U-shaped stationary core member 186 (FIG. 4) having its two ends cooperating magnetically with a pivoted armature 188 that constitutes an element of a three-way valve 190. A winding 192 is wound around core member 186. As seen in FIG. 4, this element 188 is pivoted near one of its ends on a pole piece defined by one end of U-shaped core 186 and is urged upwardly in a clockwise direction by a coil spring 194 that normally causes the end of element 188 to close one of the valve ports 197 and to allow the other aligned valve port 196 to be open (FIG. 9). Upon energization of the electromagnet, i.e. coil 192, the element 188 pivots in a counterclockwise direction in FIG. 4 against the action of spring 194 to open the port 197 and to close the part 196. In the normal position, i.e. the deenergized condition of the electromagnet, the space 130 is in communication with the chamber 201 so that fuel inlet pressure in the chamber 201 acts on the top side of diaphragm 15 (FIG. 2) to more than equalize the pressure on the bottom side of diaphragm 15 whereby gas inlet pressure maintains the valve 15, 125 closed. The gas passageways for accomplishing this is described later.

When it is desired to open the valve 15, 125, the electromagnet coil 192 is energized to thereby cause the port 196 to be closed and the vent port 197 to be opened. The port 197, now open, serves to vent the chamber 201 so that the chamber 201 assumes a pressure lower than the inlet gas pressure, i.e. a differential force is developed on the diaphragm 15 causing it to raise in FIG. 2 to open valve 15, 125. The gas passageways for accomplishing this are described later.

An important feature of the present construction involves the accurate placement and securing of the two ports 196, 197, this construction being perhaps more clearly illustrated in FIG. 9 wherein the two ports are disposed within a bore hole 204 extending through the casing member 10. This bore hole is interrupted by a slotted portion 205 through which the flapper valve element 188 extends and is movable. The two ports 196, 197 are press fitted in the bore 204 with the shouldered portions thereof engaging internal shouldered portions in the bore 204 with such shoulder portions thereby accurately locating the ports; and because of the press fit the parts are secured against movement. After assembly, as indicated, the ends of the bore holes are closed by plugs 207 and 208.

For these purposes the port 196 is in communication with gas pressure and port 197 is suitably vented. Port 197 is illustrated as being in communication with the outlet opening 119, for the main burner and this opening is, of course, at atmospheric pressure or sub gas pressure when no gas is being supplied thereto or during the initial phase of gas flow to the main burner so that the outlet opening 119 is a suitable vent for these purposes. Specifically port 197 is vented to the outlet opening 119 through the following path which includes, in turn, the bore 204, the restricted passageway 210 (FIG. 9), cavity 211, apertured portion 213 in gasket 14, the bore 215 in casing 11 which terminates in a recessed cavity 217, this cavity 217 being in communication via the rectangular slotted portion 219 (FIG. 18) in gasket 20 with the chamber 221; and chamber 221 is in communication with opening 119 via bore hole 223.

The other port 196 is in communication with chamber 130 through a path which, in turn, includes the following: bore 204, restricted passageway 225, cavity 226, apertured portion 228 in gasket 14, cavity 230 and a slotted portion 231.

Figure 3:
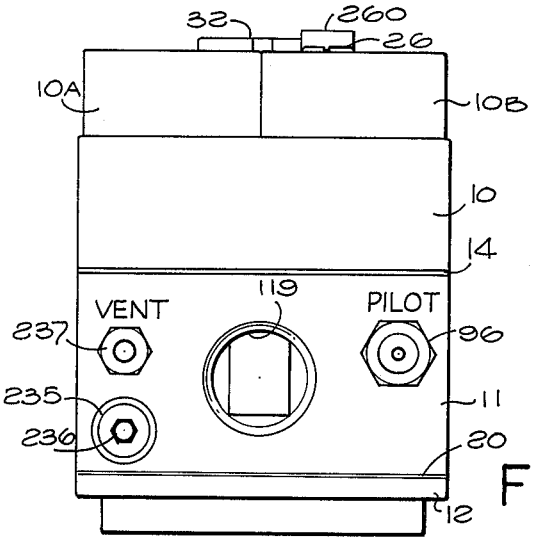
FIG. 3 is a left end elevational view of the combination valve taken on the line 3—3 shown in FIG. 1.

It is noted that the chamber 221 is also in communication with a bore hole 234 (FIG. 6) to place the same in communication with an auxiliary tapped opening 235 (FIG. 3) which is illustrated as being closed by plug 236 for use in those instances where it is desired to bleed off gas at the time gas is being supplied to the main burner as, for example, to a pilot burner.

A vent outlet 237 is illustrated as being in communication with a bore 239 (FIG. 6) which is communicated with the cavity portion 240 via the rectangular slotted portion 242 (FIG. 18) in lower gasket 20. This cavity portion 240 provides an optional venting connection and is used in those instances when it is desired to vent the three-way valve to the outlet 237 instead of, for example, to the main burner, and this is achieved simply by providing a different apertured portion in lower gasket 20 for the apertured portion 219 so that instead of such apertured portion communicating cavity 217 with cavity 221 the substituted apertured portion intercommunicates the cavity 217 with cavity 240.

Figure 19:
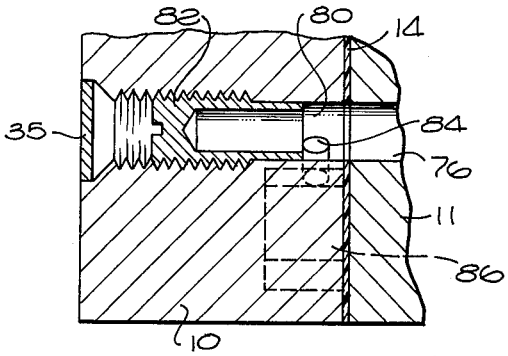
FIG. 19 is a broken away sectional view taken substantially on line 19—19 shown in FIG. 1.

Also it will be noted that two apertured portions 244, 245 (FIG. 18) are provided in the lower gasket 20 to intercommunicate the pilot gas cavity 92 (FIG. 6) with the cavity portion 247 (FIG. 7) in the lower cover member 12 and that such cavity portion 247 may communicate via gasket apertured portion 75 (FIG. 18) with the downstream side of pilot gas filter housing 70, as previously described, to obtain a main or supplemental pilot gas flow which is not controlled by the adjustable valve 82 (FIG. 19).

Figure 17:
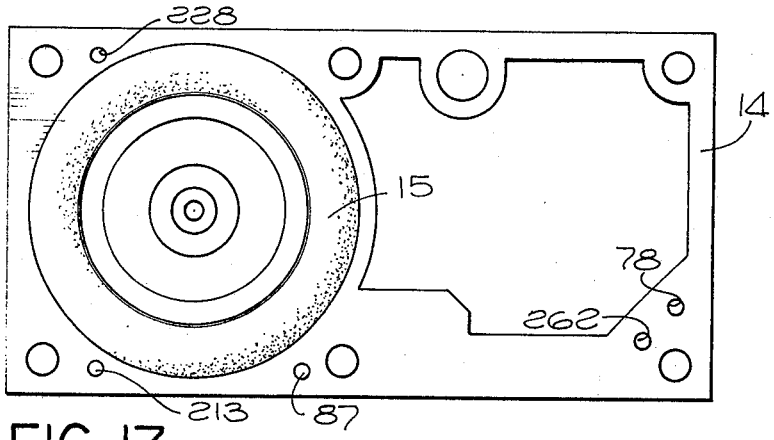
FIGS. 17 and 18 are top plan views of two respective gaskets shown in FIG. 2.

It is also noted that the upper gasket member 14 has an apertured portion 262 (FIG. 17) that serves to communicate the cavity portions 88 (FIG. 5) and 86 (FIG. 4), and thus provides a pilot gas flow path in parallel with the path through gasket apertured portion 87.

Thus it will be seen that by providing cavity portions in mating surfaces of the die cast elements and by providing a gasket between such mating surfaces, the gasket may be conveniently apertured at desired locations to selectively intercommunicate cavity portions in adjacent faces of the die cast elements to achieve a variety of arrangements without performing any machining operations on the die cast elements. This is made advantageous by disposing the four cavities, namely the diaphragm valve vent cavity 217, the pilot gas cavity 92, the vent cavity 240 and the main outlet cavity 221 adjacent each other so that by a small suitable apertured portion of gasket 20 the diaphragm valve may be vented in either of three ways, namely to the main outlet via apertured portion 219 (FIG. 18) as specifically described herein or to the pilot burner or to the atmosphere. In the latter two instances correspondingly the cavity 217 is communicated with cavity 92 and the cavity 217 is communicated with cavity 240.

Figure 18:
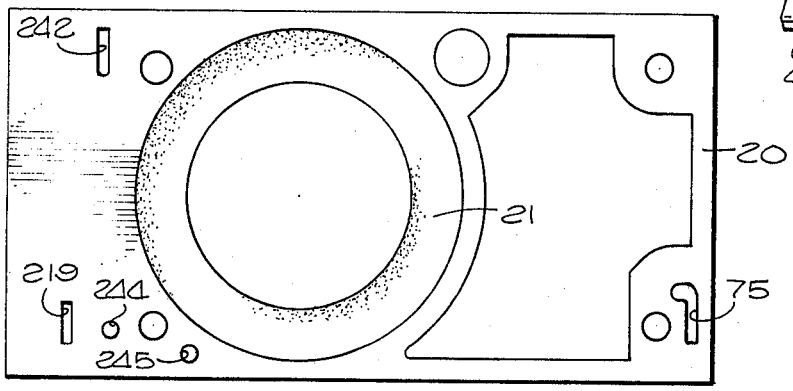

The bottom side of the pressure regulator diaphragm 21 defines one wall of a chamber 264 (FIGS. 2 and 7) which is vented to the atmosphere via a bore 250 (FIG. 7) in the circular rib 251, the bore 250 communicating with the cavity portion 252 which in turn communicates with the vent port 239 and vent connection 237 via the gasket apertured portion 242 (FIG. 18).

The terminals 26, 27 provide binding posts for connection to the diaphragm valve coil 192, and the other two terminals 28, 29 provide binding posts for the electromagnet of safety valve 46. Terminals 27 and 28 may be interconnected by a removable jumper electrical connection 260 (FIG. 1). For versatility of connections, the binding post 28 as seen in FIG. 10 is connected to the insulated contact 35 adapted to be engaged by an insulated conductor of a cable (not shown) having an outer sheath electrically connected to the metal casting 11 through a screw-threaded connection that includes the threaded portion 38.

One terminal of the electromagnet may be grounded to the die cast case leaving one terminal connectable through a slip connector 266 which provides a readily attachable and detachable connection allowing disassembly and assembly of the device.

FIGS. 1, 2, 3, 4, 8, 9, 10, 12, 13, 17, 18, 19 and 20 are identical to the same figures in U.S. Pat. No. 3,446,227. The same is true of some other of the structures disclosed herein.

Figure 7:
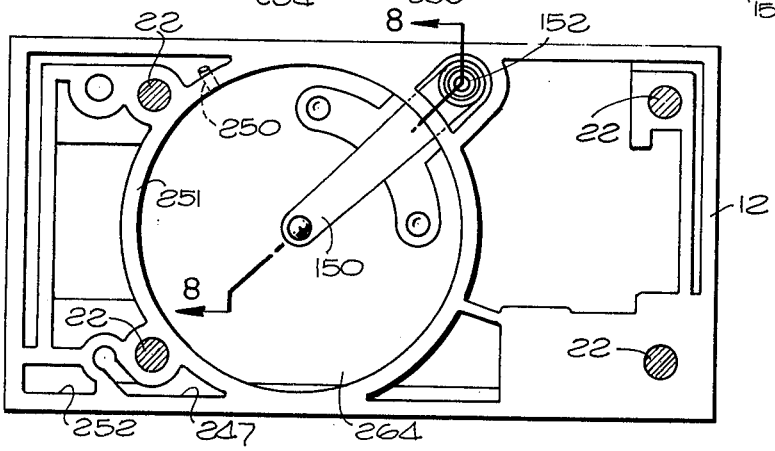

In FIG. 7, a recess may or may not be provided to guide pin A5 (FIG. 14).

A comparison of FIGS. 6, 14, 15, 16, 21, 22, 23, 24 and 25 shows the operation of the interlock assembly.

As stated previously, a rotor 61 has a recess A1, as shown in FIGS. 5, 11, 15, 16 and 25, into which pin A5 is engaged. In this case, valve disc 44 is in the dotted line position indicated at 44' in FIG. 14.

Figure 25:
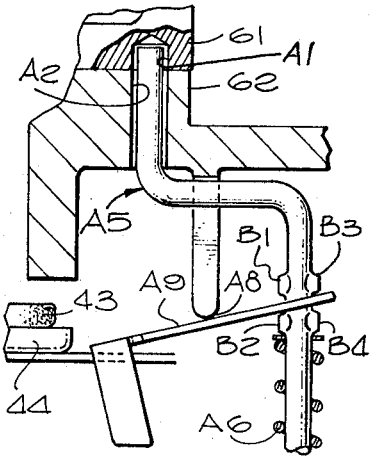
FIGS. 24 and 25 are operational views similar to that shown in FIG. 14.

Lever A9 rocks on fulcrum assembly A9' at A7 and A8 in FIG. 23. Pin A5 is also shown in FIG. 25. Pin A5 has pinched portions B1, B2, B3 and B4 which are inserted through lever A9 in FIG. 2 at notches A3 and A4. A spring A6 is shown in FIGS. 14 and 25.

A tab A12 is fixed relative to valve disc 44 in FIG. 14, but slides on lever A9.

Figure 24:
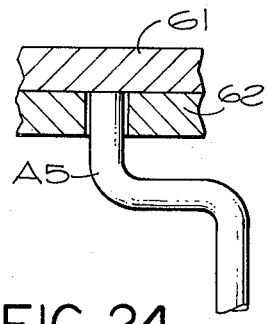

In FIG. 24, valve disc 44 (not shown) is closed, but rotor 61 has not yet been moved to the closed position.

A releasable interlock is thus positioned between valve 43 and valve rotor 61. Rotor 61 is unlocked when valve 43 closes. This occurs when the pilot of burner A15 goes out (FIG. 14) and thermocouple A14 cools.

When valve 43 is open (pilot light of burner A15 heats thermocouple A14), lever A9 is rotated counterclockwise (FIG. 14) and spring A6 presses the upper end of pin A5 against rotor 61. When rotor 61 is turned to its OFF position, pin A6 aligns with recess A1 and locks rotor 61 in a fixed position.

The present invention is not limited to the structures disclosed herein but may be employed with solenoid, bimetal, heat motor, bellows, servo, bulb, diastat assembly or other valve operators.

What is claimed is:

1. A system for controlling a combustible fluid, said system comprising: a valve body; a manual valve having a rotatable part with a flat surface; a safety valve in communication with said manual valve; a main burner; a pilot burner positioned adjacent said main burner; thermally responsive means including a thermocouple positioned adjacent said pilot burner; an electromagnet connected from said thermally responsive means to hold said safety valve open when said pilot burner is lit; a pin guided to slide axially and perpendicularly with respect to said flat surface of said rotatable part, said manual valve having a hole in said flat surface; and means to urge said pin to enter said hole when said safety valve is opened, said pin entering said hole and locking said part in a position fixed relative to said valve body when said manual valve is moved to its closed position.

2. The invention as defined in claim 1, wherein said manual valve part is rotatable about an axis, said manual valve part has a surface normal to said axis, said hole being a recess in said surface normal thereto, said pin being movably guided in said valve body in a direction parallel to said axis, said valve body having a hole therethrough with which said hole is alignable by rotation of said part about said axis.

3. The invention as defined in claim 2, wherein said means to urge said pin comprises a lever that is hinged from said pin at a predetermined point therealong at one end of said lever, the other end of said lever being movable by said safety valve, projection means on said pin, a spring coiled around said pin compressed between said projection means and said valve body, and fulcrum means fixed to said valve body for engagement with said lever.

4. The invention as defined in claim 1, wherein said means to urge said pin comprises a lever that is hinged from said pin at a predetermined point therealong at one end of said lever, the other end of said lever being movable by said safety valve, projection means on said pin, a spring coiled around said pin compressed between said projection means and said valve body, and fulcrum means fixed to said valve body for engagement with said lever.

* * * * *